United States Patent [19]

Sando

[11] Patent Number: 4,678,085

[45] Date of Patent: Jul. 7, 1987

[54] APPARATUS FOR THE DISPLAY AND STORAGE OF MATTRESSES

[76] Inventor: Daniel D. Sando, 11888 Longridge Dr., Baton Rouge, La. 70816

[21] Appl. No.: 903,706

[22] Filed: Sep. 5, 1986

[51] Int. Cl.[4] ..... A47F 7/00

[52] U.S. Cl. ..... 211/28; 211/46; 211/162

[58] Field of Search ..... 211/28, 44, 46, 40, 211/162

[56] References Cited

U.S. PATENT DOCUMENTS

| | | | |
|---|---|---|---|
| 1,257,611 | 2/1918 | Kelly | 211/46 X |
| 2,076,848 | 4/1937 | Keiver | 211/162 X |
| 2,107,576 | 2/1938 | McAnally | 211/28 |
| 2,348,398 | 5/1944 | Lorey et al. | 211/28 |
| 3,185,306 | 5/1965 | Delaney | 211/28 |
| 3,357,569 | 12/1967 | Goodman et al. | 211/28 |
| 4,036,370 | 7/1977 | Chevalier | 211/162 |
| 4,140,225 | 2/1979 | Hilgers et al. | 211/162 |

*Primary Examiner*—Robert W. Gibson, Jr.

*Attorney, Agent, or Firm*—Lewellyn A. Proctor

[57] ABSTRACT

Apparatus for the display and storage of mattresses, especially one which utilizes available space to optimum advantage, minimizes storage space, and facilitates ready removal of mattress from storage for display. The apparatus is constituted generally of a housing, inclusive of floor frame, supports, and ceiling frame providing mattress display and storage areas. Mattress display and storage carriages are suspended from and mounted on overhead tracks affixed to the ceiling, these traversing both the storage and display areas. Mattresses contained within said mattress display and storage carriages can be stored in tandem within the storage area to minimize storage space, independently transported into the display area, and mattresses unloaded for display. Suitably, a floor-attached rail within the storage area provides a ready and convenient means for the transport of a box spring upon which mattresses can be discharged from the display and storage carriages and laid out for viewing.

20 Claims, 5 Drawing Figures

APPARATUS FOR THE DISPLAY AND STORAGE OF MATTRESSES

FIELD OF THE INVENTION

This invention relates to apparatus useful for the display and storage of mattresses. In particular, it relates to a housing providing mattress display and storage areas, and mattress display and storage carriages transportably mounted on overhead tracks within said housing such that mattresses stored within said carriages can be aligned in tandem within the storage area, and individually transported to the display area.

BACKGROUND AND PROBLEMS

A mattress is a product in demand by consumers generally throughout the year, albeit demand is not necessarily even throughout the year. Mattresses are manufactured in several sizes, the most common sizes being referred to as king size, queen size and standard size. Mattresses are also made in smaller, or substandard sizes, for special purposes. Characteristically however, most if not all are bulky, relatively heavy, and quite difficult to handle. Moreover, it takes considerable space to store mattresses for which reason retail establishments must customarily set aside a relatively large area for the storage and display of mattresses.

Not uncommonly, a retailer will display one or several mattresses laid out or piled on box springs set out in a given area of a store. To the extent that an adequate number of mattress specimens representative of those in stock can be laid out for proper inspection, a customer can order a mattress of given type and style from those displayed, and a duplicate supplied to the customer from stock. This type of merchandising however is not altogether satisfactory in that considerable permanent space is required for maintaining the display, and if the mattresses must be piled on the box springs to save space considerable manual manipulation of the mattresses is necessary. Moreover, additional space is required to store the duplicate specimens not on permanent display. Mattress display and storage costs are thus relatively high in the operation of such establishments and, of course, such layout leaves much to be desired in terms of efficient distribution.

Some efforts have been made over the years to modernize, or revamp mattress storage and handling techniques. Most have been unsuccessful, or of such marginal value as to go virtually unnoticed by the industry as a whole. Apparently no mattress display and storage system has yet been developed which has attracted the attention of the industry in any significant way. Unfortunately, therefore there presently exists a need in the mattress retailing industry for an improved system, or apparatus useful for the display and storage of mattresses, particularly a system or apparatus capable of minimizing storage space and facilitating the handling and display of mattresses in a retail environment.

OBJECTS

It is, accordingly, a primary objective of the present invention to supply this, and other needs.

It is, in particular, an object of the present invention to provide novel and useful apparatus for the display and storage of mattresses, especially one which utilizes available storage space to optimum advantage, minimizes storage space, and facilitates the ready removal of mattresses from storage for display to potential customers as is required in mattress retailing operations.

Another, and yet more specific object is to provide mattress display and storage apparatus as characterized which can be readily manufactured, installed and operated with a minimum of maintainance in considerably lesser space for the storage and display of a given quantity of mattresses than conventionally required for the storage and display of said given quantity of mattresses.

THE INVENTION

These objects and others are achieved in accordance with the present invention embodying apparatus comprised of a housing, inclusive of floor frame, supports and ceiling frame mounted above the floor frame, providing mattress display and storage areas, overhead tracks one parallel to another mounted upon and supported by the ceiling frame, and mattress display and storage carriages corresponding to the number of overhead tracks such that mattresses loaded into said mattress display and storage carriages can be stored in tandem within said storage area, and each independently transported upon an overhead track from which it is suspended to said display area.

The housing, in its preferred form, provides a floor area of substantially rectangular shape, one side of which is a display area and the other an area for storage of the mattress display and storage carriages, or carriages into which mattresses can be loaded and contained. The ceiling of the ceiling frame is provided with a plurality of independently mounted overhead tracks, one parallel to another, with each extending from the storage area to the display area such that the mattress display and storage carriages, into which a mattress, or mattresses, are loaded can be stored in tandem within the storage area, and each separately removed from storage by transport into the display area. Suitably, the floor of the display area is provided with a box spring, or plurality thereof, upon which a mattress, or mattresses, can be unloaded from a mattress display and storage carriage and displayed. Preferably, the box spring, or box springs, is also mounted upon a rail, or rails, located upon the floor within the display area for guided transport across the floor to a mattress display and storage carriage unloading site. A single rail or track is generally suitable for this purpose, and in most instances preferred.

A mattress display and storage carriage is characterized as including a yoke, the upper closed portion of which is affixed through a trolley, or trolleys, to an overhead track upon which the trolley, or trolleys, runs and is transportable between the storage area and display area, and a mattress container hinged between and pivotally mounted upon the terminal ends of the downwardly faced bifurcated terminal ends of said yoke. The mattress container contains an open end through which a mattress can be loaded into, or unloaded from the container. Preferably, locking means are also provided for positioning the mattress container in a fixed position between a limit wherein the open end of the mattress container is faced upwardly as for storage of a mattress, and another wherein the open end of the container is pivoted to a horizontal or downwardly faced position to facilitate the loading or discharge of a previously loaded mattress therefrom. Preferably also, one wall of the container against which a mattress is rested is provided with rolls to facilitate the insertion and removal of mattresses from the container portion of the mattress display and storage carriers. More preferably the outwardly faced end of the roll is articulated so that the forward end of the roll is pivotable about the inwardly faced end of the roll to further facilitate the loading and unloading of mattresses of a carriage.

These and other features of this novel apparatus, as well as its principle of operation, will be better understood by reference to the following drawing and detailed description which makes specific reference to the drawing. In the drawing, similar numbers are used in the different figures to represent similar parts and components, and subscripts are used with a given whole number to designate similar parts or components where a plurality of such parts or components are employed in the structure. Where a whole number is used in the text to designate parts or components present in the structure in number greater than one, the reference is intended in a generic sense.

Figure 1:
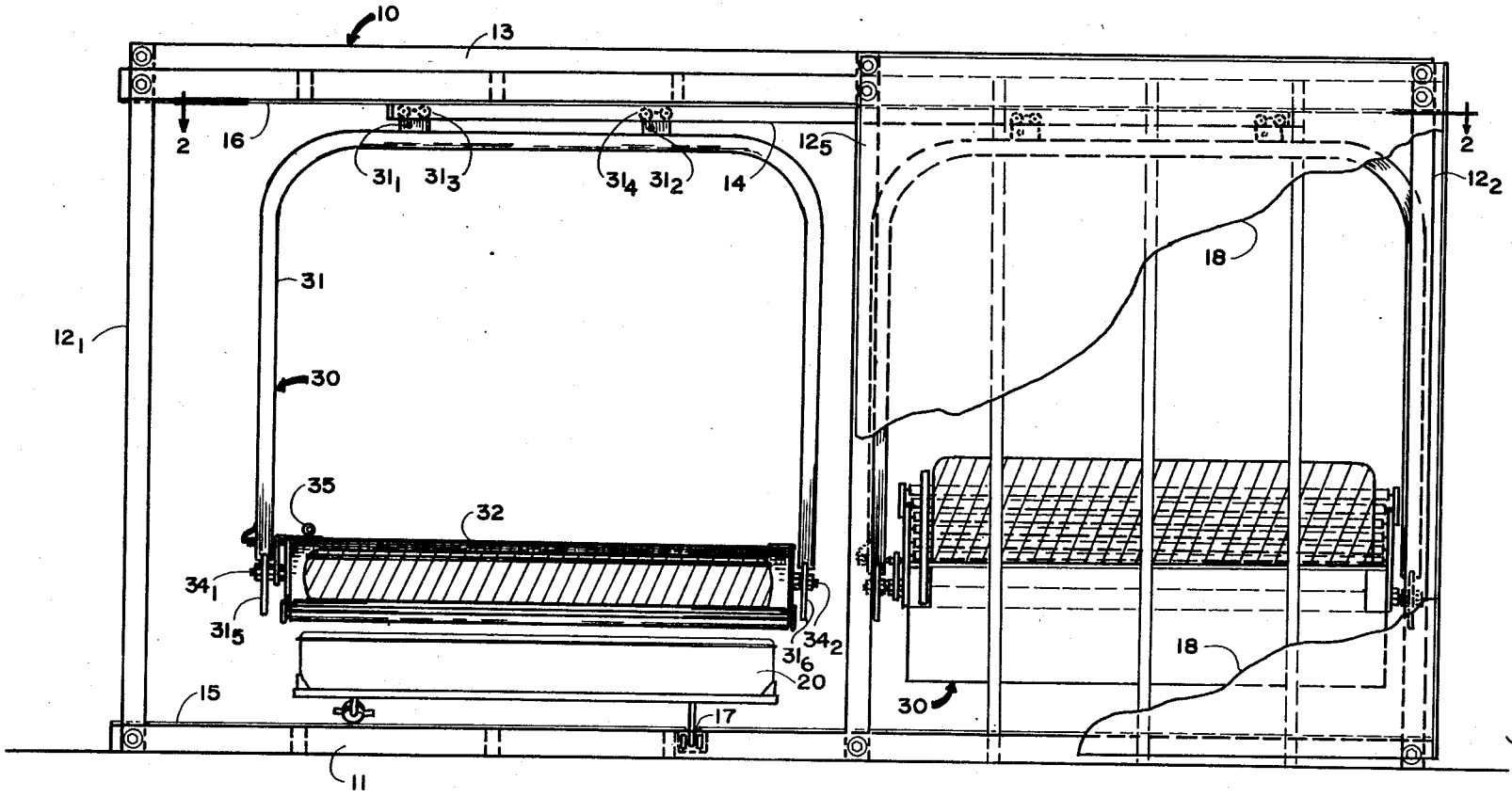
FIG. 1 is a side elevation view of a mattress display and storage apparatus, inclusive of a plurality of mattress display and storage carriages mounted upon a frame structure, the frame structure providing both a display area (left side of figure) and storage area (right side of figure).
Figure 2:
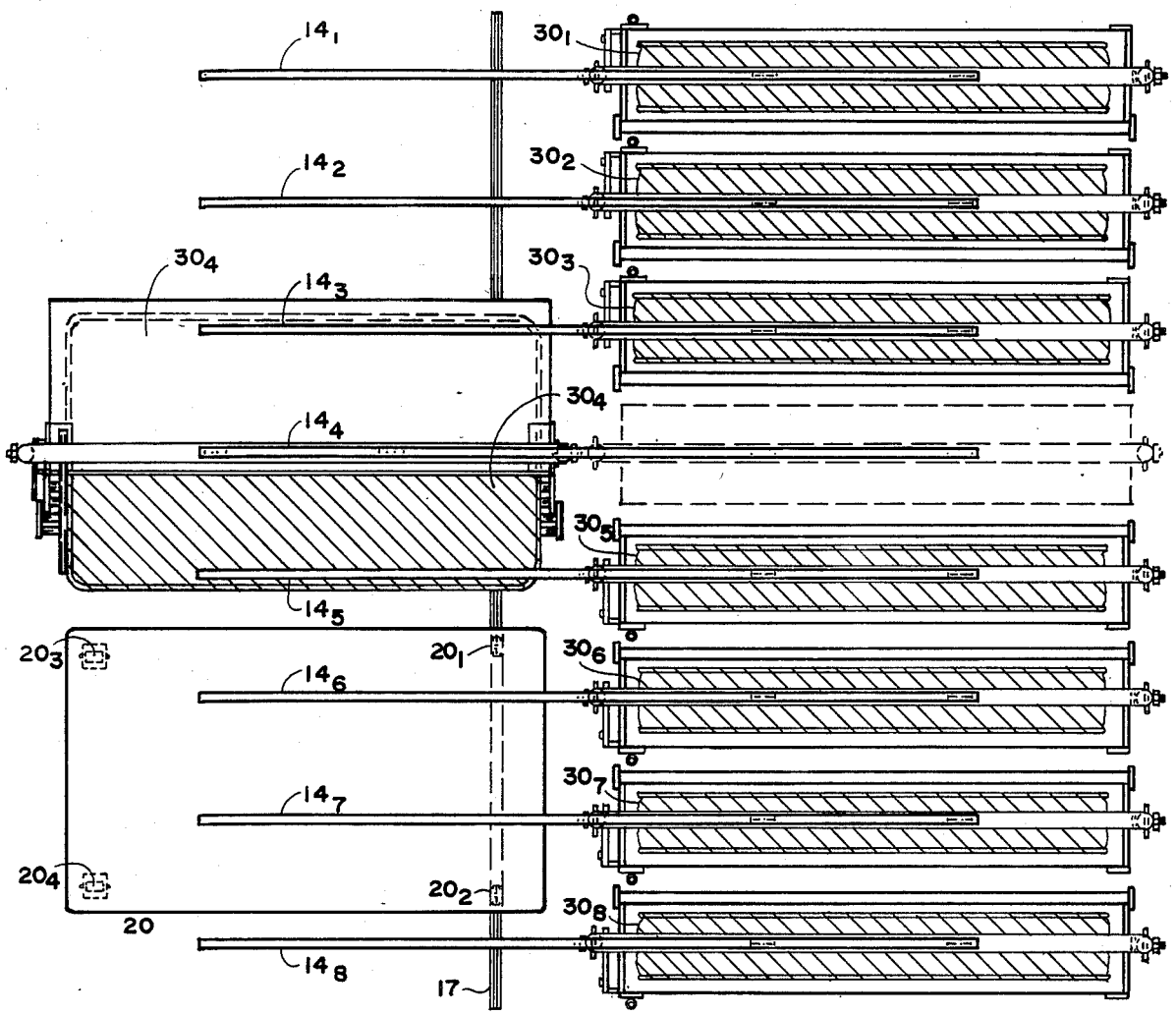
FIG. 2 is a plan view of the mattress display and storage apparatus depicted by reference to the preceding figure, the view being taken as Section 2—2 of FIG. 1.

Referring to the figures, first, principally to FIGS. 1 and 2, there is depicted generally a support structure, or housing 10 constituted of a floor module, or base frame 11 provided with vertical supports, or columns 12, and an overhead, roof or ceiling module or ceiling frame 13. The structure is modular, one-half of the total area providing a mattress display area while the balance of the area provides a mattress storage area. Mattresses are individually stored, each in mattress display and storage carriages 30 mounted and aligned in tandem within the storage area. The mattress display and storage carriages 30 are individually suspended upon overhead tracks 14, mounted upon and supported by the ceiling frame 13. Each of the mattress display and storage carriages 30 are independently movable via a track 14 from the storage area to the display area, and from the display area to the storage area.

The support structure, or open housing 10, is constituted of a floor module, or base frame 11 embodying a plurality of metal framing members $\mathbf{11}_1$, $\mathbf{11}_2$, $\mathbf{11}_3$, $\mathbf{11}_4$ horizontally aligned, arrayed and secured one end to another in the shape of a parallelogram. Vertical metal supports $\mathbf{12}_1$, $\mathbf{12}_2$, $\mathbf{12}_3$, $\mathbf{12}_4$ are mounted at the four corners of the parallelogram formed by the base frame 11, these members, with intermediate support members $\mathbf{12}_5$, $\mathbf{12}_6$, all of equal length, being attached to the base frame 11 and ceiling frame 13, respectively. The members 12 support the ceiling frame 13, formed by the metal framing members $\mathbf{13}_1$, $\mathbf{13}_2$, $\mathbf{13}_3$, $\mathbf{13}_4$ aligned, arrayed and secured one end to another to form a parallelogram substantially corresponding to the shape of the base frame 11. The metal framing members of floor frame 11 and ceiling frame 13 are further reinforced, and the structure mechanically strengthened, by the use of joists arranged parallelwise between parallel metal framing members. A wooden floor 15, suitably of plywood, is laid atop and attached to the floor joists of the floor frame 11, and similarly a ceiling 16 is formed by affixing wooden planks, or plywood, to the ceiling joists. Tracks 14, constituted of parallelly aligned overhead tracks $\mathbf{14}_1$, $\mathbf{14}_2$. . . $\mathbf{14}_8$, corresponding in number to the number of mattress display and storage carriages $\mathbf{30}_1$, $\mathbf{30}_2$. . . $\mathbf{30}_8$, are secured via metal fittings (not shown) to the ceiling frame 13, or ceiling 16, and from each is movably suspended an individual display and storage carriage.

Referring again generally to FIG. 2, it will be observed that seven of the eight mattress display and storage carriages 30 are arrayed in tandem one behind the other, and each is individually suspended from above in pendulum-like fashion from its respective track 14. These seven mattress display and storage carriages 30 lie within the storage area. The remaining mattress display and storage carriage $\mathbf{30}_4$ lies within the display area and the mattress carried therein is horizontally disposed as for the withdrawal thereof from the mattress display and storage carriage $\mathbf{30}_4$ for positioning upon the box spring 20, of substantially conventional construction. The box spring 20, it will be observed, is provided with two pairs of in-line rollers $\mathbf{20}_1$, $\mathbf{20}_2$ and $\mathbf{20}_3$, $\mathbf{20}_4$, respectively. The first pair of rollers $\mathbf{20}_1$, $\mathbf{20}_2$ are set in-line to roll upon a mono-rail 17 affixed to the floor 15, or base frame 11. The second pair of rollers $\mathbf{20}_3$, $\mathbf{20}_4$ are set in-line to roll upon the wooden floor 15 of the floor, or base frame 11, in the same direction as rollers $\mathbf{20}_1$, $\mathbf{20}_2$. Thus, as will be observed by continued reference to this figure, the box spring 20 can be readily oscillated within the display area between the two terminal ends of the mono-rail 17 for receipt of a mattress from any one of the mattress display and storage carriages 30. The box spring 20 thus can be oscillated or moved to any desired position and a carriage 30 from any one of the several storage positions can be withdrawn from the storage area to the display area, its mattress withdrawn and placed upon the box spring 20. Likewise, a mattress can be removed from the box spring 20 and returned to a mattress display and storage carriage 30.

Figure 3A:
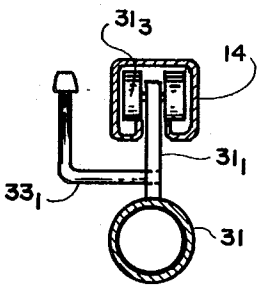
FIGS. 3A and 3B, respectively, are fragmentary sectional views taken along lines 3A—3A and 3B—3B of FIG. 3.
Figure 3B:
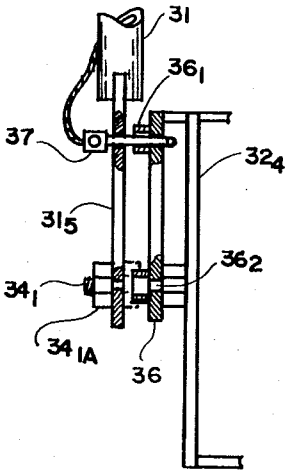
Figure 3:
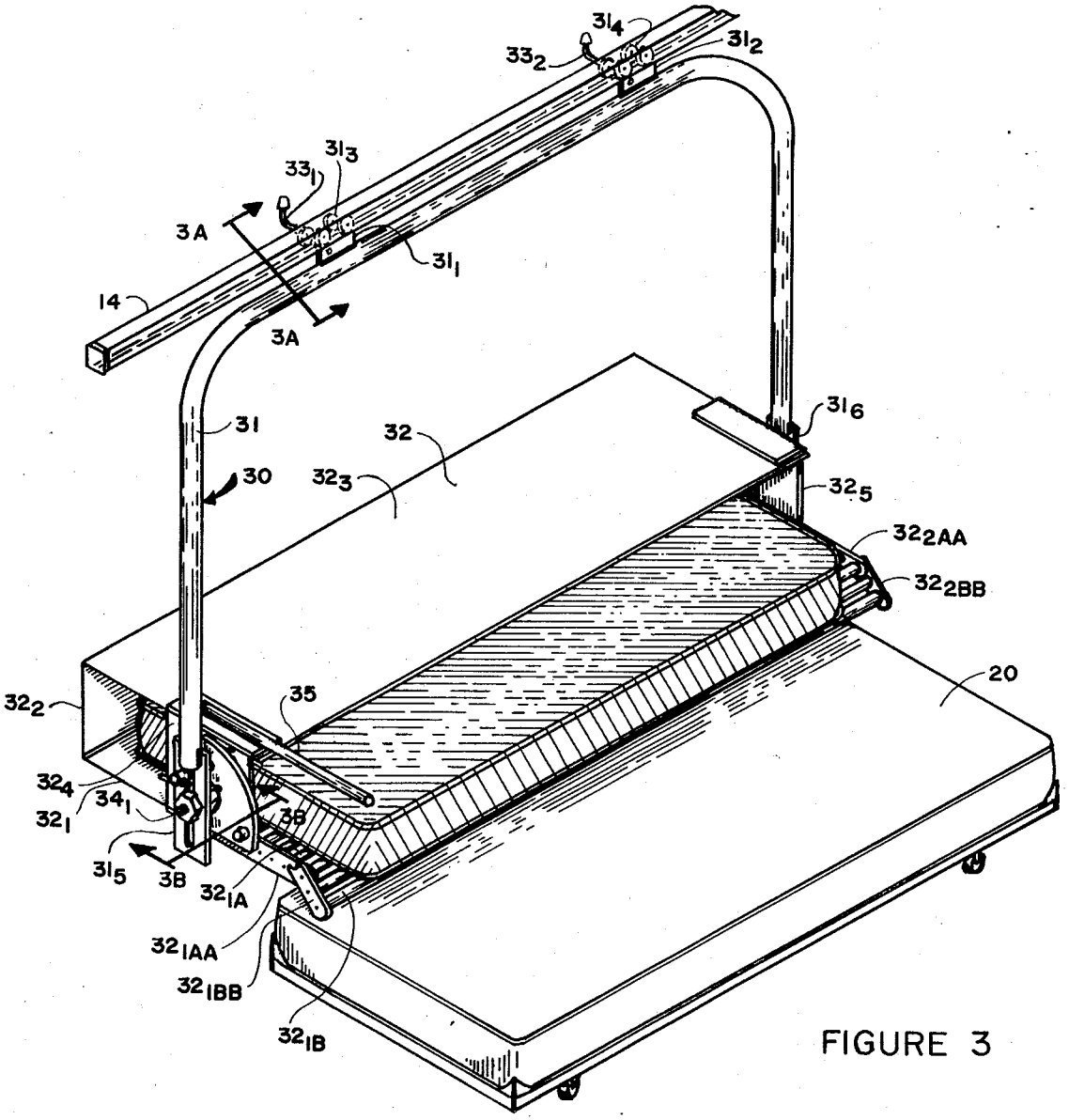
FIG. 3 is a perspective view of a mattress display and storage carriage, inclusive of a fragmentary view of an overhead track from which it is transportably suspended.

Referring principally to FIGS. 1 and 3, first to FIG. 1, it will also be observed that the storage area can be walled in, as by the use of wooden planks, plyboard or other wall forming material. Thus, walls 18 can be affixed to elongated vertically disposed studs which extend from the floor frame 11 to the ceiling frame 13. The details of construction, the manner in which the mattress display and storage carriages 30 are suspended, loaded, transported from the storage area to the display area, and unloaded, will best be described by reference to FIG. 3.

Referring specifically to FIG. 3 there is shown in perspective a mattress display and storage carriage 30, with a fragmentary section of track 14 from which it is suspended from above upon the ceiling frame 13. The display and storage carriage 30 is constituted generally of a yoke 31 having an upwardly faced closed side and a downwardly faced open, or bifurcated side from the terminal ends of the two arms of which is hinged, or pivotally attached and suspended an open-end mattress container 32. The upwardly faced closed side of the yoke 31, suitably of tubular metal, is suspended from two separated sites via metal plates $\mathbf{31}_1$, $\mathbf{31}_2$. The upper end of each of the plates $\mathbf{31}_1$, $\mathbf{31}_2$ is affixed to pendant type door trucks, or trolleys $31_3$, $31_4$ which ride within a track 14. The plates $31_1$, $31_2$ are thus secured via their lower edges to the metal yoke 31, while the trolleys $31_3$, $31_4$, located on the upper side of the plates $31_1$, $31_2$, are provided with pairs of wheels in tandem which ride on rail edges within the track 14 this permitting oscillating movement of a carriage 30 over the length of said track 14, with minimal friction, between the storage area and the display area. Side travel limiters 33 are employed on one or both sides of the yoke 31 to dampen side-to-side swaying of a display and storage carriage 30. The side travel limiters 33 are thus curved metal bars $33_1$, $33_2$ one terminal end of which is attached to a yoke 31, the opposite terminal end of which is curved in spaced relationship to the track 14 for contact with the ceiling 16 to dampen oscillations of the carriage 30 in direction other than that in which it is transported via movement along the rail 14.

Referring to FIG. 3A, there is depicted in cross-section track 14, and segment of the trolley $31_3$. The track 14 is of tubular shape, and the lower face thereof is slotted. The edges of the track 14 forming the slot, it will be observed, are turned upwardly within the closed tube to form parallelly disposed edges, or rails, at even elevation, upon which the wheels of the trolley $31_3$ roll with minimum friction. The plate $31_1$ is integrated at its upper side via openings provided with axles on which the wheels of the trolley $31_3$ are mounted, and the lower side thereof is affixed to the yoke 31. A side travel limiter $33_1$ is affixed via one of its terminal ends to the plate $31_1$, and the opposite terminal end is turned upwardly at a right angle such that it can contact the ceiling 16 to suppress side-to-side movement of the carriage 32, side-to-side oscillations of the carriage 30 being dampened by contact of the upper terminal end of the side travel limiter $33_1$ with the ceiling 16. Whereas side travel limiters 33 can be mounted on one or both sides of the yoke, they are preferably always mounted on the side of the carriage to dampen oscillations which are particularly likely to occur on loading a mattress into the container 32 of a carriage 30.

The mattress container 32 of a mattress display and storage carriage 30 is enclosed on three of its sides $32_1$, $32_2$, $32_3$, and one side $32_1$, is provided with rollers $32_{1A}$, the rollers $32_{1A}$ adjacent the open-end front side thereof projecting outwardly well beyond side $32_1$ and the plane formed by the front opening itself. The container 32 is thus formed by enclosing walls $32_1$, $32_2$, $32_3$ and side alignment plates $32_4$, $32_5$ on one of which alignment plate $32_4$ is mounted a handle 35 to facilitate the loading and unloading of a mattress. Enclosing wall $32_1$ is extended by rollers $32_{1A}$ mounted upon side extension plates $32_{1AA}$, $32_{2AA}$ to side alignment plates $32_4$, $32_5$. Rollers $32_{1A}$ are further provided with a forwardly extending articulated set of rollers $32_{1B}$ mounted on side extension plates $32_{1BB}$, $32_{2BB}$ which are hinged to side plates $32_{1AA}$, $32_{2AA}$ these facilitating the loading and unloading of mattresses therein. When the container 32 is in vertical or upright position, the open front end of the container is faced upward for containment of a mattress, or mattresses, loaded therein. For the discharge, or loading, of a mattress, or mattresses, however, the container 32 is directionally rotated, e.g. to a horizontal position, such that the rollers $32_{1A}$, $32_{1B}$ bear the weight of the mattress, or mattresses, for ready discharge, or loading; the mattress, or mattresses, being pulled across the rollers to lessen frictional resistance.

The container 32, as suggested, is hinged to or pivotally connected across the two terminal ends of the yoke 31. Each of the two terminal ends of the yoke 31 is thus affixed to a slotted metal plate $31_5$, $31_6$, respectively, providing in effect slotted extensions of the two arms of the yoke. The slotted metal plates $31_5$, $31_6$ are hinged to the container 32 via a pair of alternately disposed trunnions $34_1$, $34_2$, the trunnions $34_1$, $34_2$ being projected through the slots of the metal plates $31_5$, $31_6$ and secured and properly spaced thereupon via locking nuts. Preferably, the container 32 is rotatable about the trunnions 34 over an angle of about 90°, one extremity being when the open end of the container 32 is faced upwardly, or the container is vertically oriented, and the other wherein the open end of the container is faced horizontally, or the container horizontally oriented. A mattress, or mattresses, is thus readily retained within the container 32 as for storage when the open front end of the container 32 is faced upwardly, and readily discharged when the open front end of the container 32 is rotated 90° from vertical, i.e. to a horizontal position. In horizontal position, a mattress can thus be pulled across the rollers $32_{1A}$, $32_{1B}$ from the carriage 32 and laid upon a box spring 20, or loaded in similar fashion into the carriage 32. Preferably, the carriage can be locked, and retained in either of these two positions via a suitable locking mechanism to facilitate the loading and unloading of mattresses.

The structure by means of which the carriage 32 is hinged or pivotally connected with the yoke 31, and means by which it can be locked in position with respect to the orientation of the yoke 31 is best shown by specific reference to FIG. 3B. Referring thus to FIG. 3B, there is shown the slotted metal plate $31_5$ of yoke 31, through the slot of which is extended the trunnion $34_1$, the plate $31_5$ being pivotally attached thereto and held thereupon via the locking nut $34_{1A}$. The locking means consists of a metal plate 36 affixed to and spaced slightly outwardly from the side wall $32_4$ of the container $32_1$ a pair of holes $36_1$, $36_2$ positioned within the plate 36, and a pin 37 which can be passed through an opening in plate $31_5$ and alternately fitted into a hole $36_1$ or $36_2$ to lock the container 32 in either one of two fixed positions relative to yoke 31, viz. (a) a position wherein the open front end of the carriage 32 is faced upwardly, as for storage of a mattress, or (b) faced horizontally, as for loading or unloading a mattress. In storage position, the open-end of the container 32 is thus faced upwardly, and locked in this position, for retaining a mattress loaded therein. In displaying the mattress, on the other hand, the mattress display and storage carriage 30 is transported to the display area and brought over the box spring 20 which is moved into position, the carriage 32 is then unlocked and rotated through 90° to a horizontal position, the carriage 32 is then locked in this position and the mattress pulled therefrom across rollers $32_{1A}$, $32_{1B}$ and laid out upon the box spring 20 for display. Conversely, a mattress can be loaded in the reverse manner.

It is apparent that the various modifications and changes can be made, e.g., as in the orientation, size, shape, layout and materials of construction used in the mattress display and storage carriers, tracks, rails or the like, or in the housing, or components thereof viz. the ceiling frame, floor frame, or supports used to maintain the ceiling frame in place and in spaced relationship with the floor frame, without departing the spirit and scope of the invention.

Having described the invention, what is claimed is:

1. Apparatus for the display and storage of mattresses which, in combination, comprises a housing, inclusive of floor frame, supports and ceiling frame, providing mattress display and storage areas, a plurality of overhead tracks mounted upon and supported by the ceiling frame of said housing, each track being independently mounted and parallel one track with respect to another, a plurality of mattress display and storage carriages corresponding in number to the number of tracks, each being suspended from and independently mounted on a track such that mattresses contained within said mattress display and storage carriages can be stored in tandem within said storage area, and independently transported upon the track from which it is suspended and mounted to said display area, and a box spring located within the display area, the box spring being movable about the floor of the display area for receipt of mattresses from the mattress display and storage carriages.

2. The apparatus of claim 1 wherein the housing provides, below the ceiling, a floor area of substantially rectangular shape, one side of the floor area providing a storage area for the mattress display and storage carriages while the other side of the floor area provides a display area.

3. The apparatus of claim 2 wherein the ceiling is provided with a plurality of independently mounted tracks, one parallel to another with each extending from the storage area to the display area such that mattress display and storage carriages can be independently transported via a track from which it is suspended from the storage area to the display area.

4. The apparatus of claim 1 wherein the floor of the display area is provided with one or more rails, and one or more box springs transportable upon said rails for movement about the floor of the display area for receipt of mattresses from the mattress display and storage carriages.

5. The apparatus of claim 4 wherein the floor of the display area is provided with a single rail, and a single box spring for transport upon said rail.

6. The apparatus of claim 1 wherein a mattress display and storage carriage is characterized as including a yoke, the upper closed portion of which is provided with trolleys from which said mattress display and storage carriage is suspended and transportably mounted for running on an overhead track, and an open end container pivotally mounted on the downwardly faced open side of the yoke between the two terminal ends thereof such that the open end of the container can be faced upwardly and a mattress contained therein as for storage, or the open end thereof rotated for removal of a mattress as for display.

7. The apparatus of claim 6 wherein the pivotally mounted container portion of the mattress display and storage container is provided with locking means by virtue of which the carrier can be locked in fixed position as for storage of a mattress loaded therein, or for discharge of a stored mattress therefrom.

8. The apparatus of claim 7 wherein the locking means is characterized as including a perforated plate mounted on a side of the container, and a pin projectable through said yoke and said plate perforatins such that a terminal end of said pin can be employed as locking means permitting rotation of the carriage between a position wherein the open end of the carriage is face up and the carriage in vertical position, and position wherein the open end of the carriage traverses about 90° to a substantially horizontal position.

9. The apparatus of claim 6 wherein a pair of pendant type trolleys are mounted on the closed upwardly faced end of the yoke at separated locations in tandem one trolley in relation to the other, and each trolley is provided with sets of wheels in tandem relationship one with respect to the other.

10. The apparatus of claim 6 wherein the closed upwardly faced end of the yoke of the mattress display and storage carriers is provided with side travel limiting means to dampen oscillation of the mattress display and storage carriers other than in the direction of travel provided by the overhead tracks.

11. The apparatus of claim 6 wherein the container portion of the mattress display and storage carrier on one of its sides, adjacent its open end, is provided with rolls to facilitate the loading and discharge of mattresses therefrom.

12. The apparatus of claim 11 wherein the rolls project outwardly beyond the open end face of the container.

13. The apparatus of claim 12 wherein the outermost forward end of rolls is articulated, and flexibly movable about the innermost portion of the rolls to facilitate the loading and unloading of mattresses.

14. Apparatus for the display and storage of mattresses which, in combination, comprises a housing, inclusive of floor frame, supports and ceiling frame, providing mattress display and storage areas, a plurality of overhead tracks mounted upon and supported by the ceiling frame of said housing, each track being independently mounted and parallel one track with respect to another, a plurality of mattress display and storage carriages corresponding in number to the number of tracks, each being mounted on an overhead track by suspension from the upper portion of a carriage frame provided with rollers from which said mattress display and storage carriage is suspended and transportably mounted for running on an overhead track, and an open end container pivotally mounted on the lower portion of said carriage frame such that the open end of the container can be faced upwardly and a mattress contained therein for storage in tandem with other mattress display and storage carriages within said storage area, and independently transported upon the track from which it is suspended and mounted to said display area, and the open end thereof rotated for removal of a mattress for display.

15. The apparatus of claim 14 wherein the housing provides, below the ceiling, a floor area of substantially rectangular shape, one side of the floor area providing a storage area for the mattress display and storage carriages while the other side of the floor area provides a display area, the overhead tracks mounted upon the ceiling frame extending from the storage area to the display area such that mattress display and storage carriages can be independently transported via a track from which it is suspended from the storage area to the display area.

16. The apparatus of claim 14 wherein the display area is provided with a box spring movable about the floor of the display area for receipt of mattresses from the mattress display and storage carriages.

17. The apparatus of claim 14 wherein the floor of the display area is provided with one or more rails, and one or more box springs transportable upon said rails for movement about the floor of the display area for receipt of mattresses from the mattress display and storage carriages.

18. The apparatus of claim 17 wherein the floor of the display area is provided with a single rail, and a single box spring for transport upon said rail.

19. The apparatus of claim 14 wherein the pivotally mounted container portion of the mattress display and storage carriage is provided with locking means by virtue of which the container can be locked in fixed position as for storage of a mattress loaded therein, or for discharge of a stored mattress therefrom.

20. The apparatus of claim 14 wherein the container portion of the mattress display and storage carrier on one of its sides, adjacent its open end, is provided with rolls to facilitate the loading and discharge of mattresses therefrom, the rolls project outwardly beyond the open end face of the container, and the outermost forward end of rolls is articulated, and flexibly movable about the innermost portion of the rolls to facilitate the loading and unloading of mattresses.

* * * * *